US008082604B2

(12) United States Patent
Isaac

(10) Patent No.: US 8,082,604 B2
(45) Date of Patent: Dec. 27, 2011

(54) TOILET SEAT LIFTER AND DROPPER

(75) Inventor: Matthew James Isaac, Auckland (NZ)

(73) Assignee: Pedaloo NZ Limited, North Shore (NZ)

( * ) Notice: Subject to any disclaimer, the term of this patent is extended or adjusted under 35 U.S.C. 154(b) by 1088 days.

(21) Appl. No.: 11/913,453

(22) PCT Filed: May 3, 2006

(86) PCT No.: PCT/NZ2006/000094

§ 371 (c)(1),
(2), (4) Date: Nov. 2, 2007

(87) PCT Pub. No.: WO2006/118478

PCT Pub. Date: Nov. 9, 2006

(65) Prior Publication Data

US 2008/0189843 A1 Aug. 14, 2008

(30) Foreign Application Priority Data

May 3, 2005 (NZ) ..... 539794

(51) Int. Cl.
*A47K 13/10* (2006.01)

(52) U.S. Cl. ..... 4/246.3; 4/246.2; 4/246.5

(58) Field of Classification Search ..... 4/246.1–246.5
See application file for complete search history.

(56) References Cited

U.S. PATENT DOCUMENTS

| | | | | | |
|---|---|---|---|---|---|
| 1,276,472 | A | * | 8/1918 | Zeen | 4/246.4 |
| 1,792,811 | A | * | 2/1931 | Bustin | 4/246.4 |
| 5,339,468 | A | * | 8/1994 | Lin | 4/246.5 |
| 5,404,595 | A | * | 4/1995 | Carmel | 4/246.1 |

FOREIGN PATENT DOCUMENTS

| | | | |
|---|---|---|---|
| JP | 10028660 | A | 2/1998 |
| JP | 10257999 | A | 9/1998 |
| WO | 0139648 | A1 | 6/2001 |

OTHER PUBLICATIONS

International Search Report of PCT/NZ2006/000094, date of mailing Jul. 12, 2006.

* cited by examiner

*Primary Examiner* — Brian Glessner
*Assistant Examiner* — Patrick Maestri
(74) *Attorney, Agent, or Firm* — Young & Thompson

(57) ABSTRACT

A mechanism (100) for lifting and lowering a toilet seat (102) is activated by foot pressure pushing down on a pedal (104). The mechanism includes an off-floor pivot fixed in space for converting the pressure into a torque applied to hinge (113, 114) supporting the seat. The mechanism does not touch the floor. Instead a reaction arm which is one support for the fixed pivot presses against a wall (120) behind the toilet bowl. An element for retarding the speed of the seat as it falls is optionally included.

8 Claims, 3 Drawing Sheets

TOILET SEAT LIFTER AND DROPPER

FIELD

Figure 1:
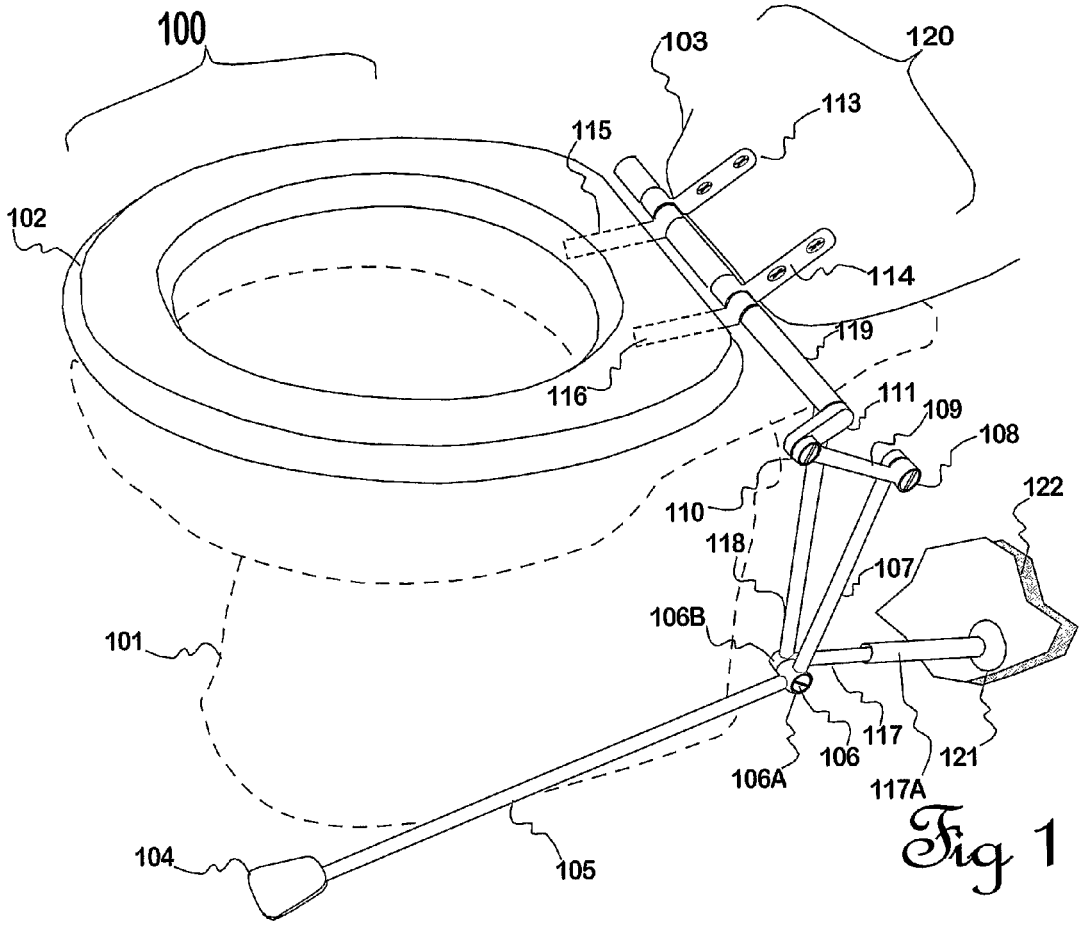

This invention relates to foot-activated mechanical means to raise and lower a hinged toilet seat.

BACKGROUND

A commonplace toilet includes a porcelain receptacle or bowl, to the rear of which a seat and a lid are separately attached by means of hinges. There is a sex difference between men and women in which men generally stand at a toilet bowl to micturate, while women sit down. (Both sit down for defaecation, at least in Western cultures). Unless the seat is lifted, urine may if misdirected land on the seat and this is considered extremely unhygienic. There is a tendency amongst men to not lower the seat after use and this is a problem to subsequent users. If the bowl has to be cleaned with such as a brush, the seat should also be lifted in order to avoid drips landing on the seat and for better access. It has been the common practice to raise and lower the toilet seat manually, by grasping the seat end and lifting or lowering the seat edge accordingly. However the toilet seat is one of the most non-sterile items in a house; even more so where a toilet is available for use by the public or a sub-group thereof. People are somewhat disinclined to touch the seat and are more likely to (further) contaminate the seat by failing to lift and lower it.

Installations in (for example) aircraft, trains, restaurants, garages, hospitals and municipal facilities are liable to become highly contaminated, repulsive, and hence comprise public health risks. Many diseases are liable to be spread under these conditions, including the enteric bacterial infections like salmonellosis, and shigellosis; also viruses such as polio-myelitis and some influenzas, and occasionally protozoan and helminth (worm) infections.

There is, therefore, a need to replace the manual control of the toilet seat with an easy, hands-free procedure.

Rubbish bins in which a floor-referenced pedal lifts a lid so that rubbish can be placed inside the bin are well-known, but differ in that the lifting is "momentary" rather than "bistable" (to use electronics terminology) and in that the lifting member can be built under and through the actual bin, whereas toilet bowls cannot be disassembled or drilled in that manner.

PRIOR ART

A search using classification (A47K 13/10), supported by word searches disclosed over 650 publications. None of these included all the main integers of the present invention, namely: 1; activated by a foot pedal, 2; does not touch the floor, 3; does press against the rear wall, and 4; the mechanism uses levers, pivots and accesses the seat at the hinge shaft. For example, Pettus (U.S. Pat. No. 6,189,160) has a foot pedal and uses levers and pivots, but does not make use of the rear wall and does touch the floor by relying on a fulcrum on a platform, thereby causing a cleaning problem. Nearly all of the existing patents or published applications have significant disadvantages. For example, it is desirable that with the increasing sophistication of bathrooms and toilets that a retro-fitted or new seat lifting device does not use or deface the floor or other surfaces. Further, it is desirable that a seat lifting device does not obstruct any floor or wall cleaning procedure. It is also desirable that the seat lifting device is simple, and for example does not require an external power supply. Few if any of the patents reviewed in that class satisfied the above requirements. In relation to the movement dampener of Example 2 and FIGS. 4-6, Hellwig (EP 1199020) describes a movement dampener within a toilet seat hinge; one of two being for the seat and the other being for the lid, though not associated with a seat lifting mechanism. Make describes an automatic water-powered lid per responding to flushing of the toilet in U.S. Pat. No. 5,884,342, but no raising action is disclosed.

OBJECT

It is an object of this invention to provide a no-touch yet simple and practical means to lift and lower a toilet seat without breaching personal hygiene standards, or at least to provide the public with a useful choice.

STATEMENT OF INVENTION

In a first broad aspect this invention provides a hands-free mechanism for use as a toilet seat lifter and dropper wherein the mechanism employs a first rigid beam having a bend located intermediate between a first end and a second end of the first beam; the first beam connecting an actuating pedal affixed to the first end of the first beam to a first end of a connecting rod through a first pivot means placed at the second end of the first beam; the first beam having an axis of rotation in a vertical plane about a second pivot means that is held at a fixed position in space and placed at or about the bend in the first beam; the second end of the connecting rod being pivotally linked, by a third pivot means, to a first end of a crankshaft fixedly fastened at a second end to a rotatable member of a hinge assembly affixed to the rear of a toilet bowl, to which rotatable member is attached at least one radially projecting mounting means fastened to the toilet seat so that the seat may be raised or lowered by rotation of the rotatable member.

In a first related aspect this invention provides that the second pivot means is fixedly located at a position in space by means of (1) a second rigid beam, connected at a first end to a sleeve surrounding the rotatable member of the hinge assembly affixed to the rear of the toilet bowl, and connected at a second end to the second pivot means; the second beam being oriented generally in a vertical direction and (2) a third, rigid beam affixed at a first end to the second end of the second beam and extending generally horizontally and away from the actuating pedal; a second end of the third beam being in contact with a rear wall of an enclosure at least partially surrounding the toilet seat, so that, when in use, downwards movement of the actuating pedal is converted by rotation about the second pivot means into substantially horizontal motion of the first pivot means, thereby forcing the crank, via action of the interposed connecting rod, to apply a torque to and thereby to cause rotation of the rotatable member of the hinge assembly and thereby to cause the toilet seat to be rotated about the hinge, wherein the hands-free mechanism has no parts in contact with or affixed to a floor of the enclosure about the toilet bowl, and the hands-free mechanism may be rotated away and upwards from contact with the rear wall about the axis of rotation of the hinge assembly in order to gain access to the floor such as for cleaning purposes.

In a second related aspect this invention provides that the third beam is of an adjustable length so that the second pivot means may be adjusted to lie at a consistent position in space in different installations; the position being substantially beneath an axis of the rotatable member of the hinge assembly.

In a third related aspect this invention provides that the second and third rigid beams are the same beam, including a bend at the position of the second pivot means.

In a second broad aspect the invention provides a hands-free mechanism for use as a toilet seat lifter and dropper that is reversible, so that when the seat is down and hence in a stable position a press on the foot pedal lifts the seat up, while if the seat is up and hence in a stable position a similar press on the pedal makes the seat fall down into a closed position.

In a first related aspect this invention provides that when the toilet seat is at rest in the closed position and the relative alignment of the crank beam is such that an acute angle exists between the axis of the crank and the currently higher axis of the connecting rod, a downwards movement applied by the user on to the pedal will be converted, by means of a torque applied to the crank, into rotation in a seat-opening direction of the rotatable member of the hinge assembly thereby causing an opening movement of the seat past a neutral balanced position and into a second, stable, or seat up position, and conversely, when the seat is in the second position, the changed alignment of the crank is such that an acute angle exists between the axis of the crank and the currently lower axis of the connecting rod so that a downwards movement applied by the user on to the pedal will be converted into a closing movement of the seat past the neutral position and into a stable, seat-down position.

In a third broad aspect the invention provides a hands-free mechanism for use as a toilet seat lifter and dropper; the mechanism including a slow-drop device having two parts capable of relative movement and capable of applying a viscous drag on movement in a first direction of relative movement but not in a second opposite direction is incorporated between moving parts and parts of the mechanism fixed to the toilet bowl so that, when in use, the slow-drop device serves to resist motion of the seat in the direction in which the seat is falling, but which offers relatively low resistance to raising of the seat.

In a first related aspect this invention provides that at least one rotatable slow-drop device is incorporated within the hinge assembly fastened to the rear of a toilet bowl and about the rotatable member of the hinge assembly; the rotatable slow-drop device interposed between the rotatable member and a fixed part of the hinge assembly, so that when the seat is falling the slow-drop device will apply a viscous drag on relative movement so that the seat will fall more slowly, although the slow-drop device offers relatively low resistance to raising of the seat.

Preferably the or each rotatable slow-drop device includes a grease as a viscous liquid and means to force the grease through a small opening between a first chamber and a second chamber when the first part of the rotatable slow-drop device is turned in a first direction relative to the second part, and means to allow the grease to return through a large opening when the first part of the rotatable slow-drop device is turned in an opposite direction relative to the second part.

In a fourth broad aspect the invention provides a hands-free mechanism for use as a toilet seat lifter and dropper wherein the mechanism is sold as a part of a new toilet bowl with seat.

In a fifth broad aspect the invention provides a hands-free mechanism for use as a toilet seat lifter and dropper wherein the mechanism is provided with a cover over the pivots; the cover including a reclosable opening on one side, so that the cover conceals the levers and pivots.

PREFERRED EMBODIMENT

The description of the invention to be provided herein is given purely by way of example and is not to be taken in any way as limiting the scope or extent of the invention.

Throughout this specification and the claims which follow unless the text requires otherwise, the word "comprise" and variations such as "comprising" or "comprises" will be understood to imply the inclusion of a stated integer or step or group of integers or steps but not the exclusion of any other integer or step or group of integers or steps.

DRAWINGS

FIG. 1: is a perspective view of an installed device.

Figure 2:
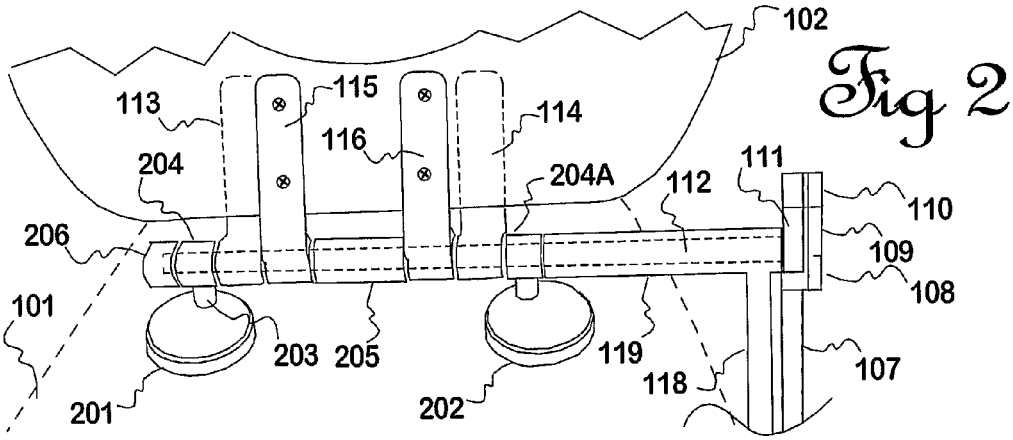

FIG. 2: is a perspective view of the hinge assembly.

Figure 3:
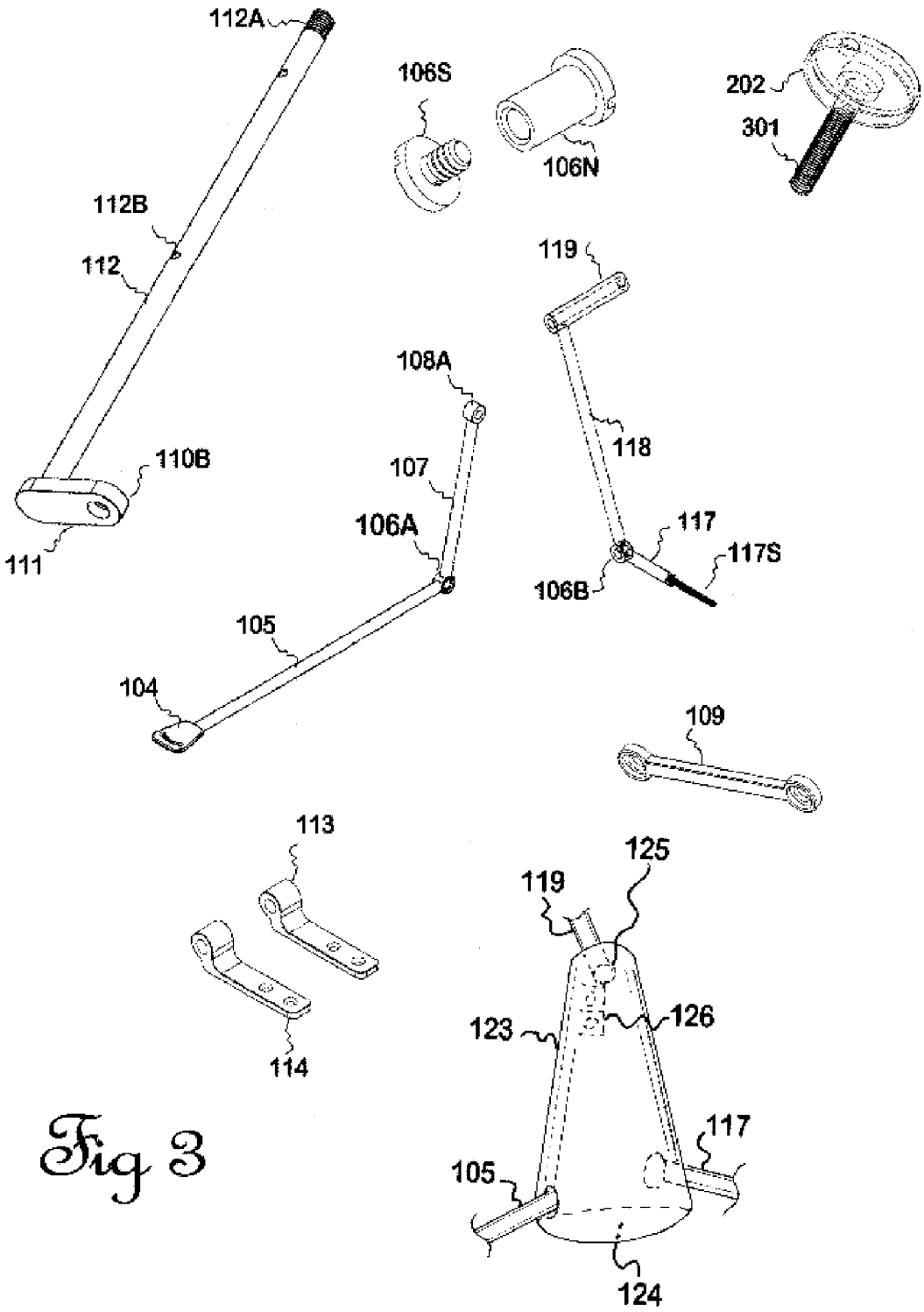

FIG. 3: shows some components of the invention, in isolation.

Figure 4:
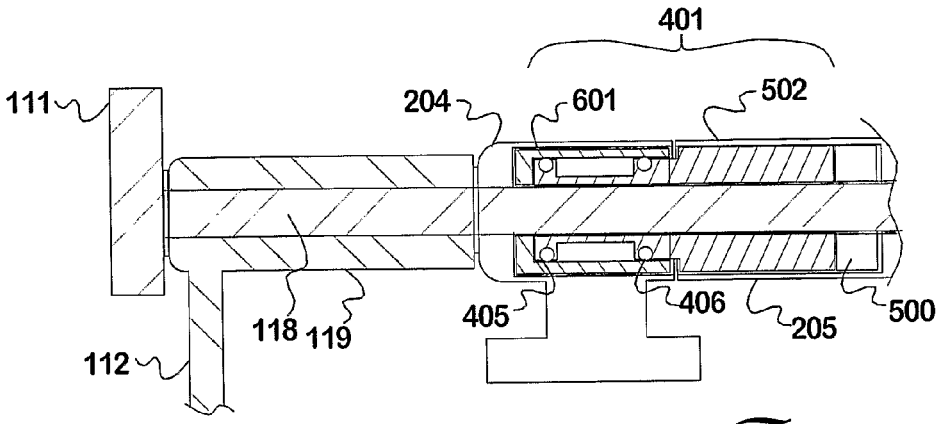

FIG. 4: shows, in cross-section, one "slow-drop" hinge cartridge within the hinge.

Figure 5:
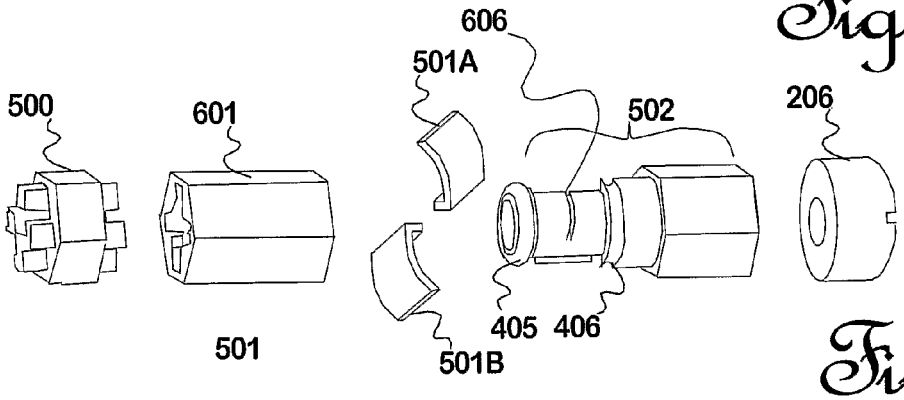

FIG. 5: shows the other "slow-drop" hinge cartridge in exploded view.

Figure 6:
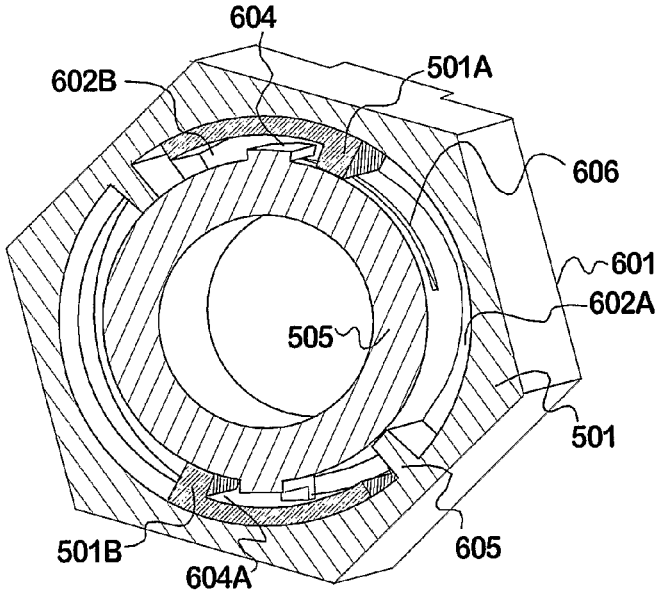

FIG. 6: shows, in cross-section, details of the "slow-drop" mechanism.

This invention relates to a device for lifting and lowering a toilet seat, in which a system of pivots and articulated members converts a pushing force applied downwards to a foot pedal into a torque around a rotatable shaft within a hinge, while relying on a reaction force developed against a rear wall behind the toilet bowl. The device is firmly fastened to the toilet bowl at or near the existing hinge mounts. No part of the device touches the floor, and the device may be pivoted away from the rear wall for easier cleaning.

Example 1

This example is shown in the perspective view of FIG. 1, and some component parts are shown in FIG. 3. Any dimensions given herein are illustrative only. FIG. 1 shows the lid in an opened position and the seat in a lowered position. Note that the lid can be rotated forwards so that the lid lies over the position of the seat as shown, and the seat can be lifted and rotated by the mechanism shown so as to lie against the seat in the opened position. This example is for a right-footed pedal although a left-footed pedal is equally feasible to provide. The example 100 illustrates the system of pivots and articulated members that converts a force on the foot pedal 104 into a torque applied to a rotatable shaft 112 forming part of a hinge assembly attached to the toilet seat 102, while relying on a reaction force developed against a rear wall 122 behind the toilet bowl 101. The part of the device beyond the hinge assembly 120 is firmly fastened to—and only to—the toilet bowl 101 at or near the existing hinge mountings (not shown in FIG. 1) but the device may be swiveled (in a clockwise direction, with reference to FIG. 1) away from the wall and upwards by rotation about the hinge axis. We use the term "pivot" or "pivot group" to include the assemblies comprising the pivot pin (FIG. 3; 106N and 106S which screw together) together with those gudgeons (such as those at each end of the connecting rod 109) that surround and swivel upon, each pivot pin. The three sets of pivots referred to generally as 108, 106 and 110 use as an axle for rotation a mating pair (FIG. 3 106S and 106N) of components. The "nut" 106N includes an internal thread matching the protruding thread on the modified screw 1063. These are shown with slotted heads for adjustment by means of a screwdriver although other well-known forms of head (such as "Philips" or heads including "hex" or other shaped apertures such as for security bolts) may be used. The exterior of the nut 106N serves as a bearing surface for the articulated beams which are held in place by the "cheese-head" enlargements at each end. Washers used in the pivot assemblies on both sides of an articulating member are preferably made of a self-lubricating resilient plastics material. The mating pair (106N, 106S) is made so that the screw and nut do not loosen once tightened, and any of the means known to those skilled in the engineering arts can be used to ensure that they remain locked together yet do not limit movement of the articulating beams.

The Seat Lifting Operation.

Pedal 104 is preferably set at about 60-80 mm above the floor so that downwards movement does not touch the floor. The pedal is fixed (welded, perhaps) to the pedal arm 105 which connects at an angle (104 degrees is an example preferred angle) to a pedal-arm 107 extending upwards to terminate at a first pivot housing or gudgeon 108A around a first pivot assembly 108. The pedal arm 105 further incorporates a rigidly affixed second pivot housing or gudgeon 106A around a second pivot assembly 106 at a junction with said pedal arm 107. Dimensions of one example (provided without any intention that they be limiting) are: pedal 104 edge to centre of second pivot housing 106A: 430 mm, and length of pedal arm 107 from centre of second pivot housing 106A to centre of first pivot housing 108A: 200 mm. This unit is shown in isolation in FIG. 3. Hence the pedal 104 and the first pivot housing 108A may move, each in a locus centered on the second pivot assembly 106 which is fixed in position in space. In this Example, second pivot assembly 106 is held in a fixed position in space by the second gudgeon 106A, fixed to sleeve 119 at one end of the second rigid beam 118 on to part of the hinge assembly 120 mounted on the fixed toilet seat, and the end of a third rigid beam 117 is pressed against rear wall 122. Movement of the first pivot assembly 108 towards the left side of the diagram causes the connecting rod 109 (105 mm in length from first pivot 108 to third pivot 110) to be forced towards the left side of the diagram, which has the effect of causing third pivot group 110 to be forced to move. The third pivot assembly 110 is constrained by crank 111 (length 35 mm from third pivot 110 to the axis of shaft 112) to rotate about the axis of the hinge assembly 120. Consequent clockwise rotation of the crank 111 causes the central shaft 112 of the hinge assembly, (length about 290 mm) to which crank 111 is firmly fastened, to rotate in a clockwise direction (with reference to FIG. 1) thereby causing the hinges 115 and 116 beneath the seat to be turned by means of firm attachment of these hinges to the shaft 112 (such as by using grub screws), hence causing the seat 102 to be lifted up. The second pivot assembly indicated by 106 is held firmly in space, with reference to a rear wall 122, by (A) a third rigid beam 117, 117A between the second gudgeon 106A at the second pivot 106 and a resilient pad, the wall foot plate 121 pressing against the wall. The third beam is adjustable in length by means of a telescoping joint employing threaded stud 117S (see FIG. 3) connecting arm (or third rigid beam) parts 117 and 117A. The wall foot plate is usually biased, by the weight of the linkage, to rest against the wall so that when the pedal is pressed there is no initial "dead movement". Second pivot assembly 106 is also held firmly in space by (B) another gudgeon 106B on the end of second rigid beam 118 which is securely attached (welded) to an outer sleeve 119 about the hinge assembly 120 and drops down to second pivot assembly 106. Please note: the hinge assembly is described in more detail with reference to FIG. 2. Thanks to this design, no part of the invention 100 requires to approach, touch or be attached to the floor. Although second and third beams are referred to as separate items it may be more convenient to bend a single beam and attach a gudgeon at or about the bend.

The user would generally work the pedal with a firm push, rather than a very gradual pressure, so that the seat remains in the lifted position, once lifted, by having sufficient momentum to pass a point of neutral balance (when the seat is about vertical), and falls backwards to reach a stable position against the lid.

The Seat Lowering Operation.

The invention is also capable of lowering the seat by means of a push on the foot pedal. A push on the pedal 104 while the seat is in the lifted position is also coupled in the manner as described above to the crank 111 which (being rigidly coupled to the hinge arms supporting the seat) is now in a position rotated by about 30-50 degrees clockwise of (above) the position shown in FIG. 1. Forced movement of the connecting rod against the now elevated crank applies a "lowering" anti-clockwise torque to the central shaft 112 of the hinge assembly which rotates in an anticlockwise direction so that the seat is brought forward (to the left of the diagram) and once it passes the position of neutral balance it falls towards the lowered position. This bistable yet moveable position of the seat is achieved by adjusting the direction of the crank 111 to be about parallel to the direction of the connecting rod 109 when the seat is in neutral balance, when the invention is installed. The reader will appreciate that if the invention could only lift the seat its utility would be diminished. Example 2 will describe an improvement to the seat lowering operation.

The Seat and Lid Raising Operation.

If the superimposed lid 103 happens to be down and covering the seat when the seat is lifted, the lid is also raised. The hinges that are fastened on to the lid (113 and 114) are free to rotate about the shaft of the hinge assembly.

The Hinge

FIG. 2 illustrates details about the hinge assembly 120 (in FIG. 1), for the Example without a dampener. 101 (dotted outline) is the top rear of the porcelain toilet bowl, provided as is the usual case with mounting holes for hinges. 102 is the lifted seat (partially shown). Fixed rod 118 is firmly attached (welded) to sleeve 119, thereby determining that some motions of the invention shall be concentric with the hinge. Considering this aspect in isolation, forcing pedal-arm 107 to move closer to a state of parallelism with fixed-arm 118 by application of a downwards force to the pedal 104 of FIG. 1 causes crank 111 to be rotated. Since (as in FIG. 3) the crank 111 is firmly fixed (such as by welding) to the inner shaft 112 of the hinge assembly, the inner shaft 112 is thereby caused to rotate through part of a circle. The hinge assembly is held by sleeves 204, 204A that surround the inner shaft 112. The sleeves are mounted on supports (203) eccentrically raised up from each of a pair of wide bolt heads 201 and 202 (although a single strip of a rigid material may be substituted for the two heads). Preferably a soft buffer layer is placed beneath the strip or the heads 201, 202 in order to protect the ceramic from localised pressure. Each bolt shaft (301—FIG. 3) is passed through a hole provided in the rear of the porcelain toilet seat and may be fixed in place, using the eccentrically placed supports to confer a degree of lateral and forwards/backwards adjustability, or just to cope with hole placement, when setting up the invention. A soft washer is used beneath (for example) a hand-operated wing nut that clamps both bolt heads 201 and 202 in place. Between the sleeves 204, 204A are two sets of hinge arms: 113 with 114 (supporting the lid), and 115 with 116 (supporting the seat), and a spacer 205. Not shown in FIG. 2 are spacing washers between parts of the hinge assembly. Preferably these, like the washers used in the pivot assemblies, are made of a self-lubricating resilient plastics material. The seat hinge arms are fastened to the shaft 112 such as by grub screws tightened against flats 112B. The far end of the hinge assembly is provided with a covering head 206 having an internal female thread and preferably including serrations or the like to minimise any risk of becoming loosened during use.

Example 2

This version (see FIG. 4 (assembled, cross section), FIG. 5 (exploded view), and FIG. 6 (details)) of the invention includes an example of a movement dampener so that the seat, while being lowered, does not collide heavily with the porcelain bowl. An unrestrained "free-fall" collision of this type is noisy and may result in breakage. The movement dampener may encourage people to close the lid. The dampener is active in the direction of rotation taken when the toilet seat is moving down. This example provides one solution to the problem. The specific example described and illustrated herein is but one possible solution to the provision of a rotational, one-way dampener.

The preferred version of the dampener as shown in FIGS. 4, 5 and 6 operates between rotating members, rather than in a linear mode like the piston of the well-known gas lift device, and is incorporated within the hinge, slightly thickened to about a 30 mm diameter instead of the 20 mm diameter of the Example 1 version in order to accommodate the mechanism. Two dampeners are made as cartridge type inserts and are used in a symmetrical placement, although this description refers to just one of them. The principle of this example dampener is the use of flaps (501A, 501B) which engage with a viscous material when the dampener rotates in one direction, and which are disengaged when rotated in the other direction. The flaps are held in a grease-filled space within an internal assembly or cartridge (FIG. 4, 401) which is firmly coupled to the rotating axle 112 by the hexagonal, matching exterior of part 502 that fits within a hexagonal internal space inside tubular component 205, which in this example is fixed to shaft 112, as a housing. The flaps work against an internal shell of part 501 that is firmly coupled (again preferably by means of a hexagonal exterior profile) to that non-rotating portion of the hinge assembly 204, (and on the other side, 204A) that is bolted onto the porcelain toilet bowl. The preferred method of providing firm coupling is to use hexagonal (or other polygonal) exterior profiles that fit snugly inside hexagonal (not circular) holes within the hinge components 204 and 205). Of course, other methods known in the engineering arts such as the use of keyways, retaining grubscrews, and/or glues could be used instead.

The viscous material (preferably a grease or an oil selected for a long life under the conditions) is held in the divided space 602A, 602B surrounding the extension 505 of unit 502 (produced to the left side in FIG. 5) and inside item 501. Preferably two O-ring seals are placed at 405 and 406. The internal components may be replaced if worn or if the properties of the grease are degraded, preferably by changing the whole cartridge. FIG. 6 shows details of the mechanism for providing a viscous drag when the toilet seat is lowered. Part 505 may be rotated forcibly (through up to about 180 degrees) in relation to the surrounding hexagonal cross-section part 501. If this rotation is clockwise, the low projections on part 505, 604, 604A engage with the base of the adjacent flap 501, 501A and cause it to move clockwise and become tilted (by rotation in an anticlockwise direction about the base) thereby relatively readily admitting grease from the first portion of chamber 602 here labelled 602A, over the top (outside) of the flap and into the second portion of the chamber here labelled 602B. The flap cannot move past projection 605 which also serves to isolate 602A, 602B from the diametrically opposite chambers, 602C and 602D. The flap would approach that position when the seat is up.

On returning the seat to the downwards position, the flap 501A is pushed anticlockwise by relative movement of projection 605, and in this direction the flap is not tilted. Hence substantially the only escape for grease present in the (now enlarged) chamber 602B and being compressed by the moving flap is through the small slit orifice beneath the flap here labelled 606 and into chamber 602A. This orifice presents greater resistance to flow than the route of over the top (outside) of flap 501A and so the cartridge presents greater viscous drag when its parts are rotated relative to each other in this direction. Materials should be selected for durability under expected operating conditions and applied torques and would include suitable diecast metals or strong plastics material or a combination of both.

Example 3

This Example (an addition or improvement) conceals at least some of the rods and pivots of the invention within a loose, easily cleaned shroud 123 (FIG. 3), in part to help with user acceptability. The shroud may be made of an opaque, decorative, flexible, cleanable (or disposable) material that covers connecting rod 111, link 109, and beams 107 and 118. It has a closed top, and an open bottom 124 and has an aperture 125 at one side near the top to allow sleeve 119 to emerge horizontally from near the top of the shroud. Access to the aperture for mounting or removal purposes is provided by a resealable slit 126 (using press-fit fasteners as are well known in the plastics arts) that also serves as a retention means.

Variations

Structural materials used in the prototype seat lifter are stainless steel such as the alloy known as 316. This material is strong, resists wear and resists corrosion, and is easy to clean. It is relatively expensive and hard to machine, so suitable alternatives should be mentioned. These include steel treated to eliminate corrosion, aluminium, preferably anodised in order to prevent corrosion, wood (at least in part) and selections from a range of structural plastics and blends or alloys thereof. It is difficult to specify a choice on account of continuing developments and changing prices, but suitable materials include high-density polyethylene, polycarbonate, polyethylene terephthalate, and fibre-reinforced plastics including glass or carbon fibres. In order to reduce the strains imposed on bent joints (such as for both members articulating at joint 106) a web or a brace may be used to bridge the joint itself and thereby reduce the amount of material required in this application. Components shown here as circular rods may have elliptical and/or tubular cross-sections. At least some components may be made by injection moulding (for plastics) or casting (for metals).

The beam reaching backwards to touch the wall (117, 117A) is required to be adjustable over a significant range because the wall position "as built" in relation to the toilet position will vary. In the prototype the adjustability is provided by means of a threaded stud 117B. In order to extend the range, a selection of beams 117A of different lengths may be provided, or a telescoping extension using spring-loaded locking means to hold the extension at a set length, supplemented by a threaded adjustment. Alternatively a long beam is provided and the installer saws or cuts the beam to length as required.

A small force-spreading pad 121 is normally provided at the end of shaft 117A. This pad may be made larger for use with walls not capable of supporting the reaction force that occurs during use (such as plaster board), or a rigid plate such as of metal may be provided for secure fastening on to a weaker wall.

If the invention is sold as part of a manufactured toilet seat assembly (rather than being sold as a later accessory to be added) some factors such as material strength may be optimised for a particular lid weight and seat weight. Toilet seat height is relatively consistent, so that pedal height should not need to be a concern.

An alternative to the Example 2 version of the invention employs counterbalancing springs, preferably within the hinge assembly, to help compensate for a relatively heavy seat. The prototype example has a wooden seat and lid, which are heavier than plastic equivalents. Such springs may be adjustable.

This invention allows the lid 103 to swing passively about the hinge assembly 120. It is pushed up, when down, if the seat is lifted but then it stays up (during use of the toilet) until manually returned for purposes such as to confine an aerosol caused during flushing. At this point there is no provision to lower the lid by means of movement of the pedal (such as by attaching the lid to the seat) because that would prevent people from sitting on the toilet. Hence the lid is to be lowered by hand.

As previously mentioned, this invention can be made in a right-foot version, in a left-foot version, or even in a version wherein a pedal is provided on both sides of the hinge assembly. Choice may be useful within a particular toilet as constructed, or because some users may be disabled in one foot. Since shaft 112 runs the length of the hinge assembly it is simple to couple a pedal assembly on to both ends of the shaft.

Dimensional changes that optimise this invention for installation in the standard aircraft toilet have not yet been developed, such as with reference to the available space. However the principles of the invention as described and as claimed would be applied in the same way.

INDUSTRIAL APPLICABILITY AND ADVANTAGES

The invention provides a no-touch, convenient means for lifting and lowering a toilet seat. This aids users in configuring the toilet to their particular needs, or in configuring the toilet to a default mode after use.

A public facility is less likely to become soiled over a given period between cleaning.

The invention substantially reduces both perceived and actual risks of transference of disease. By its use, public heath risks such as the spread of an epidemic are reduced.

As compared to other inventions for the same purpose, the present invention is not based on any floor-mounted apparatus. It is instead swung from the hinge axis and is simply pressed against the wall of the room behind the toilet.

No external source of power is required.

The present invention and the toilet on which it is mounted can be cleaned easily, partly because there are no floor obstructions and partly because the invention can be temporarily swung forwards and upwards about the axis of the hinge assembly, leaving the space it had occupied when in use clear for mopping or other cleaning operations.

Finally, it will be understood that the scope of this invention as described and/or illustrated herein is not limited to the specified embodiments. Those of skill will appreciate that various modifications, additions, known equivalents, and substitutions are possible without departing from the scope and spirit of the invention as set forth in the following claims.

I claim:

1. A hands-free mechanism (120) for lifting and lowering a seat (102) of a toilet (100) situated within an enclosure, the mechanism being actuated by pressure from a user's foot, the mechanism comprising:

a first, movable rigid beam (105, 107) having a first end bearing an actuating pedal (104) located above a floor of the enclosure and a second end including a first pivot means (108) shared with a first end of a connecting rod (109), the first rigid beam having a first bend (106A) located intermediate between the first end and the second end, said first bend being at or near a second pivot means (106) allowing an axis of rotation of said first rigid beam in a vertical plane, said second pivot means being held at a fixed position in space; and a second fixed rigid beam including a first part (118) and a second part (117), said second rigid beam having a second bend (106B) located intermediate between the first part (118) and the second part (117), the second bend being at or near the second pivot means (106), the second part (117) having a third end (121) for being placed in contact with a rear wall (122) of the enclosure, and the second beam having a fourth end fixed in a radial aspect on to an end of a hollow shaft (119) that is rotatably mounted by mounts (204, 204A) to a bowl (101) of the toilet, said second beam arranged to hold the second pivot means (106) in space without any contact with a floor of the enclosure, a second end of the connecting rod (109) being pivotally linked, by a third pivot means (110), to a free end of a crank (111) fastened at an angle with respect to the toilet seat (102) to a rotatable shaft (112) passing through the hollow shaft (119), the rotatable shaft having attached thereto at least one radially extended mounting means (115, 116) fastened to the toilet seat (102), wherein, when in use, a downward force operationally applied to the pedal is coupled through first beam (105, 107) and through connecting rod (109) to the crank (111), thereby causing rotation of the rotatable member (112) resulting in the seat (102) being rotated.

2. The hands-free mechanism as claimed in claim 1, wherein the length of the second part (117) in between the second bend (106B) and the third end (121) is adjustable in length for allowing the second pivot means (106) to be located at a consistent position when in use, the consistent position being substantially vertically beneath an end of the rotatable shaft (112).

3. The hands-free mechanism as claimed in claim 2, wherein a direction of the crank (111) about the shaft (112) to which it is joined is approximately parallel to a direction of the connecting rod (109) when the seat is in a neutral balance, thereby providing a latching function so that a first operational press on the pedal (104) will cause the closed seat (102) to be lifted up into an open position, and a second operational press on the pedal when the seat is open will cause the seat to be lowered into a closed position.

4. The hands-free mechanism as claimed in claim 1 wherein the hands-free mechanism may be rotated about an axis of rotation of the hinge assembly away from contact with the rear wall (122) and upwards in order that the floor may be cleaned.

5. The hands-free mechanism as claimed in claim 1, further comprising:

a slow-drop device having two parts incorporated between moving parts of the mechanism and parts of the mechanism fixed to the toilet bowl, the two parts being capable of relative movement and configured to restrain movement in a first direction of relative movement but not in a second opposite direction so that, when in use, the slow-drop device resists motion of the seat in the direction in which the seat is falling, but which offers relatively low resistance to a raising of the seat.

6. The hands-free mechanism as claimed in claim 5, wherein the slow-drop device is rotatable and is incorporated within a hinge assembly fastened to the rear of a toilet bowl and about a rotatable member of the hinge assembly, the rotatable slow-drop device that is interposed between the rotatable member and a fixed part of the hinge assembly including at least one internal flap capable of changing an area of a channel through which fluid can flow consequent on an applied force causing the internal flap to change position, so that when the seat is falling the slow-drop device will apply a high viscous drag on relative movement so that the seat will fall slowly, the slow-drop device being configured to apply a low viscous draft to the raising of the seat.

7. The hands-free mechanism as claimed in any of claims 1-6, wherein the mechanism is provided as a part of a new toilet bowl with seat.

8. A hands-free mechanism as claimed in any of claims 1-6, wherein the mechanism is provided with a removable cover over the pivots, the cover including a reclosable opening on one side admitting the end of the hinge assembly beside the crank so that the cover conceals the levers and pivots.

* * * * *